US005347299A

United States Patent [19]

Entz et al.

[11] Patent Number: 5,347,299

[45] Date of Patent: Sep. 13, 1994

[54] SHEET FILM CARTRIDGE FOR THERMAL DYE PRINTER

[75] Inventors: Steven F. Entz, Hilton; Bradley S. Jadrich, Rochester, both of N.Y.; Gunther Schoelpple, Kirchheim/Nabem, Fed. Rep. of Germany

[73] Assignee: Eastman Kodak Company, Rochester, N.Y.

[21] Appl. No.: 824,977

[22] Filed: Jan. 24, 1992

[51] Int. Cl.[5] ..... B41J 11/00; B41J 2/435

[52] U.S. Cl. ..... 346/76 L; 346/76 PH; 346/134

[58] Field of Search ..... 346/134, 76 PH, 76 L

[56] References Cited

U.S. PATENT DOCUMENTS 5,066,962 11/1991 Sarraf ..... 346/76 L

*Primary Examiner*—Benjamin R. Fuller
*Assistant Examiner*—Huan Tran
*Attorney, Agent, or Firm*—Robert L. Randall

[57] ABSTRACT

There is described a tray-like cartridge for supplying thin delicate sheets of dye done film in a thermal printer. The cartridge has a slidable lid which normally covers a portion of the cartridge containing a factory-supplied package of film. The lid has a specially shaped window through which sheets of film may be drawn one-by-one from the cartridge for use in the printer. When the cartridge is not in the printer, the lid window is closed. This keeps the film free of dust and protects it from damage. The shape of the lid and its window act in conjunction with a film feeding mechanism of the printer to insure absolute reliability in the separating and feeding of individual sheets of film. Another portion of the cartridge serves as a waste bin for used sheets of the film.

14 Claims, 2 Drawing Sheets

SHEET FILM CARTRIDGE FOR THERMAL DYE PRINTER

FIELD OF THE INVENTION

The present invention relates to an improved cartridge and film package holder for supplying sheets of thermal dye film in a laser printer such as used to make high quality color prints and transparencies.

BACKGROUND OF THE INVENTION

This invention is particularly useful in, but not restricted to, a thermal printer such as described in U.S. patent application Ser. No. 457,593, filed Dec. 27, 1990 in the names of S. Sarraf, et. al., and having a common assignee with the present patent application. This printer thermally prints an image on a receiver element, which may be in the form of a slide transparency, by scanning a laser beam across a dye-donor element held against the receiver element (e.g., slide transparency). The laser beam is modulated by input data corresponding to the image to be printed. The modulated beam, which is focused to a small spot, is swept across the donor element a line at a time by an electromechanical galvanometer which rotates a mirror to deflect the laser beam linearly. Thermal energy from the focused spot of the laser beam causes small dots or pixels of dye from the donor element to thermally react and to transfer pixel-by-pixel to the receiver element. A finely detailed image is thus printed on the receiver element by the pixels of dye from the donor element. When such a printer is used for making a color image, separate thermal dye colors (for example, cyan, magenta and yellow) are printed in sequence on the receiver element. It is advantageous to supply these colors on separate sheets or sections of donor film which are placed in succession against the receiver element onto which a color image is being printed. Thermal dye films suitable for this use are disclosed in U.S. Pat. No. 4,973,572, which has a common assignee with the present patent application.

From the standpoint of operating convenience and to obtain a more compact mechanism, it has been found to be desirable for the dye-donor film to be supplied in a thermal printer, such as disclosed in the above-identified patent application, as separate sheets packaged in a stack. Sheets of film are grouped in sets in a desired sequence of colors, and a convenient number of such sets are stacked together in a package. Because mishandling of and even minute amounts of contamination or dirt on the sheets of dye-donor film can cause visually objectionable spots and imperfections in a printed image, it is highly desirable that the film be kept in a clean and protected environment. The sheets of film should be delivered to the point of use in a thermal printer in an easily accessed package or cartridge with the film sheets properly grouped in sets in the individual sequences in which they will be used. The feeding of the individual sheets of film from the cartridge by the printer mechanism must be done with absolute reliability, but yet carefully, to avoid damage to the dye surface of the film. The present invention provides a highly effective yet inexpensive answer to these requirements for a dye-donor sheet film cartridge in a laser thermal printer.

SUMMARY OF THE INVENTION

In accordance with the present invention in a preferred embodiment thereof, there is provided a cartridge and a cup-like container or package for supplying in a desired sequence of colors sheets of dye donor film to a thermal printer. The film container is loaded by the manufacturer with a package of the dye-donor film and delivered to the point-of-use in a sealed condition which insures both cleanliness and a selected sequence of the dye-donor sheets in that order in which they are used in the thermal printer. The film container itself is an inexpensive cup-like member which, after the package of film delivered in it has been used up, may be discarded or recycled. The container is inserted in proper relation into the cartridge, its factory cover or seal removed, and a top lid of the cartridge is placed over the open container. In this condition the cartridge provides safe storage of its package of film while outside of the thermal printer. This arrangement also enables one cartridge with a package of film of one color sequence to be easily removed at any time from the printer and another cartridge with a similar or different sequence of film colors to be inserted into the printer.

When a cartridge with its container of film is inserted into a printer, a fixed detent or shoulder on the frame of the printer engages a sliding cover within the top lid of the cartridge. This opens a "window" through which the film, sheet-by-sheet, can be drawn from its container and used in the printer. The "window" in the cartridge lid is specially shaped to insure absolute reliability in the feeding of the sheets of film one at a time in the printer. The shape of the window also helps to preclude scraping or mechanical damage to the delicate dye coated surface of each sheet of film as it is being withdrawn from the cartridge.

The cartridge in addition to supplying film to the printer provides a convenient waste bin for the sheets of film after they have been used. Thus disposal of the used film is readily accomplished. After a package of film has been used, the cartridge with an empty film container and full waste bin is removed from the printer. The cartridge may then be emptied of waste film and of the empty film container. A new container with a fresh package of film is then loaded into the cartridge. The cartridge itself is also designed to be inexpensively fabricated. Thus, if desired, the use of a number of cartridges for a given printer is economically feasible. This adds to operating flexibility and convenience in that different colors and sequences of dye-donor film are easily loaded into the printer and used as desired.

More particularly the present invention is directed to a film cartridge for a laser printer. The cartridge comprises a tray-like body which defines first and second cavities, the first cavity is adapted to receive a package of sheets of film to be used one-by-one in the printer, and the second cavity is adapted to receive waste sheets of film after they have been used in the printer. The cartridge further comprises a lid slidably mounted on the tray-like body for normally covering the first cavity and for leaving the second cavity open when a package of sheets of film is present. The lid has window which is normally closed when the cartridge is removed from the printer and is open when the cartridge is inserted in the printer such that individual sheets of film may be extracted one-by-one from the package through the lid window for use within the printer and the film is protected from contamination and damage when the cartridge is not in the printer.

A better understanding of the invention, together with its important advantages will best be gained from a consideration of the following detailed description taken in conjunction with the accompanying drawings and claims.

DETAILED DESCRIPTION

Figure 1:
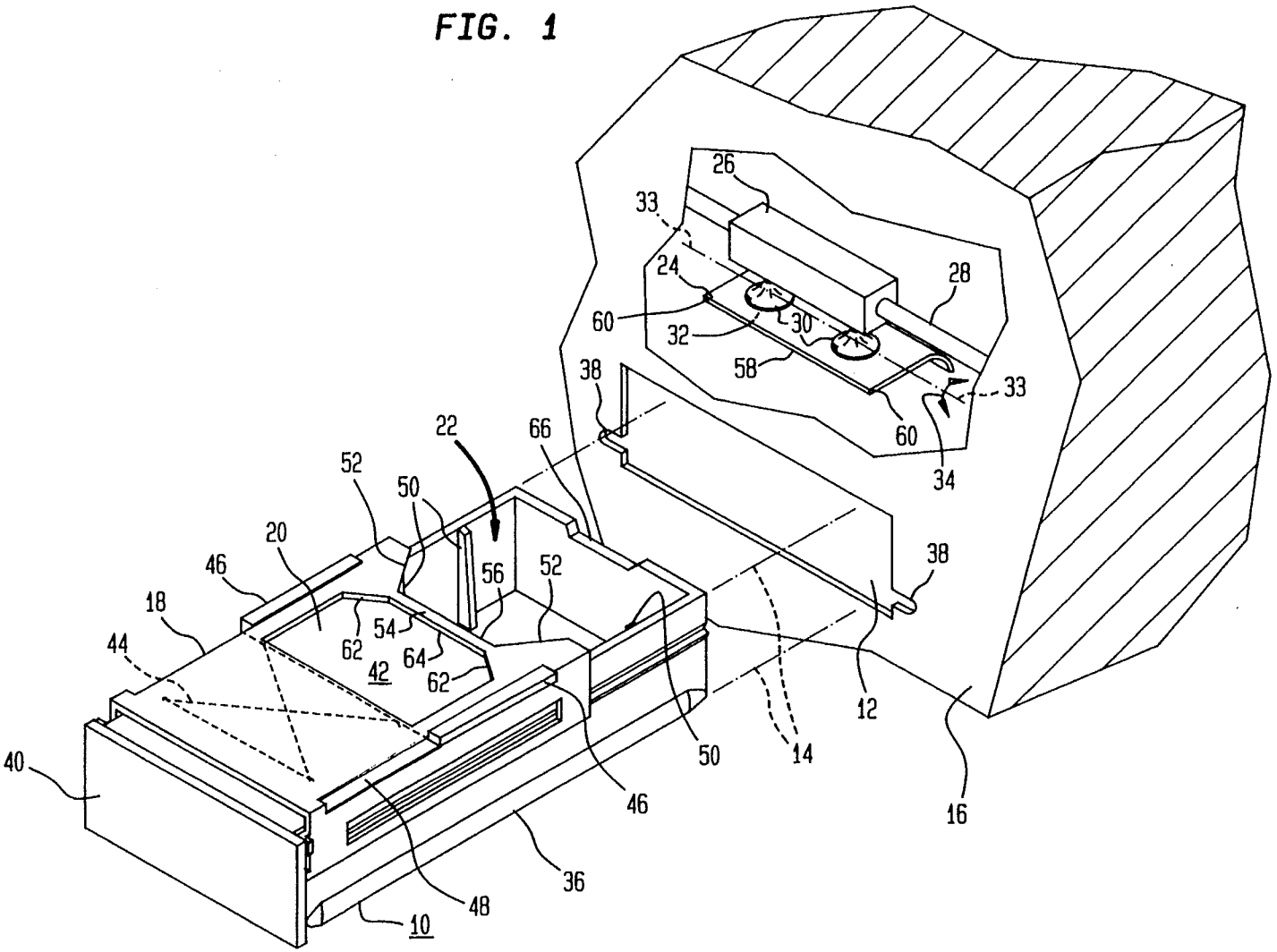
FIG. 1 shows a perspective view of a film cartridge in accordance with the invention and shows how the film cartridge is used with a thermal printer (shown schematically and partially broken away)

Referring now to FIG. 1, there is shown in perspective view a tray-like film cartridge 10 embodying features of the invention. The cartridge 10 is adapted to be inserted (as indicated by the dashed lines 14) through an opening 12, into a laser thermal printer 16 shown here schematically and partially broken away. The thermal printer 16 is for illustrative purposes the same one that is disclosed in the U.S. patent application Ser. No. 457,593 which is described in the Background of the Invention. The cartridge 10 has a top lid 18 which in turn has a specially shaped "window" 20 formed therethrough. The lid 18 and cartridge 10 will be described in detail shortly. However, as shown here with the cartridge 10 outside of the printer 16, the lid 18 is positioned over the front portion of the cartridge 10 and the window 20 is closed. Thus a package of film (not seen here) contained within the front portion of the cartridge 10 is covered and protected. When the window 20 is open, access is provided to the film package beneath the lid 18 in the front portion of the cartridge 10. The rear portion of the cartridge 10 is open and defines a waste bin 22 for used sheets of film (not shown here in the bin 22).

A single sheet 24 of film (seen through a broken away portion of the printer 16) is shown being held suspended above the level of the cartridge 10 by a feed mechanism 26. This mechanism is mounted on an arm 28 which (by means not shown) is movable back and forth, up and down within the printer 16 for the purpose of supplying and removing individual sheets 24 of film to and from a printing location in the printer 16. The feed mechanism 26 includes a pair of suction cups 30 by which a single sheet 24 of film is picked up and held with its delicate dye coated surface facing down or underneath as indicated at 32. The feed mechanism 26 is rotatable angularly about its lengthwise axis 33 (as indicated by the dashed line passing through the suction cups 30) in an angular direction indicated by a double-headed curved arrow 34. This rotating or angular movement of the feed mechanism 26 is used in removing individual sheets of film from the cartridge 10 for use in the printer 16 as will be described shortly. So long as vacuum or negative pressure is exerted by the cups 30, a sheet 24 of film is held by the feed mechanism 26. When the vacuum is released, the sheet 24 is released by the feed mechanism 26. The cartridge 10 and its lid 18 (with window 20) are designed to act in conjunction with the feed mechanism 26 in insuring absolute reliability in the feeding of film sheets 24 one-by-one and in protecting delicate dye surfaces 32 of the sheets from damage. A sheet 24 of film is typically thin and flexible. When it is held by the suction cups 30, the unsupported section of the sheet "dangles" or flexes slightly rather than remaining rigidly flat.

The cartridge 10 has a pair of side rails 36 (only one of which can be seen here) which fit through corresponding side cutouts 38 in the front opening 12 and guide the cartridge 10 into the printer 16 and locate it properly. When fully inserted into printer 16, the cartridge 10 is held in indexed relation to other elements of the printer (not shown) and to the feed mechanism 26. When the cartridge 10 is fully inserted into the printer 16, a front panel 40 of the cartridge 10 closes the opening 12.

As mentioned previously, the window 20 in the cartridge lid 18 provides access to the supply package of film (not shown in FIG. 1) when the cartridge 10 is inserted in the printer 16. Until that time, the window 20 is closed by a slidable slat-like member 42 which is urged into the position shown here (in which it closes the window 20) by a flat "hairpin" spring 44 (shown here in dotted outline). The slidable member 42 has a pair of outer shoulders 46 which slide back and forth along a pair of guide slots 48 in the lid 18. These shoulders 46 retain the member 42 in the lid 18. The lid 18 itself, as a complete assembly, with the member 42 and the spring 44, can be slid backward on the cartridge 10 from the position shown to expose a storage cavity for inserting a film package in the front part of the cartridge 10. When the cartridge 10 (with the lid 18 in its normal forward position as shown here) is inserted into the printer 16, the shoulders 46 are engaged by a fixed member (not shown) within the printer 16. This pushes the member 42 forward along the slots 48 in the lid 18 from the position shown. This provides access by the feed mechanism 26 to the unused sheets of film stored in a supply package in the front portion of the cartridge 10.

The horizontal dimensions of the waste bin 22 in the rear portion of the cartridge 10 are such that used sheets 24 of film can lie flat in the bin 22. By way of example, a sheet of film may be 70 mm square and about 4 mils thick and there may be as many sheets eventually stacked one on top of another in the bin 22 as there were originally in a fresh package of film. There are a series of vertical side ribs 50 within the bin 22 which add structural rigidity to the cartridge 10.

When the cartridge 10 is fully inserted into the printer 16, the open top of the waste bin 22 is positioned so that the feed mechanism 26 can move over and then down to the bin 22 to deposit a sheet 24 of film after it has been used and then removed from a printing location within the printer 16. It is noted that the rear edge of the lid 18 is somewhat "U" shaped with angular corners 52 connected by a narrow thin strut 54 having a rear edge 56. This rear edge 56 is far enough forward so that it does not interfere with a front edge 58 of a sheet 24 of film as it is being deposited by the feed mechanism 26 into the waste bin 22. The angled corners 52 of the lid 18 however do interfere slightly with the front corners 60 of a film sheet 24 so that as the sheet is being pushed down into the bin 22, sheet corners 60 of the sheet 24 "snap" down underneath the lid corners 52. Thereafter, when the suction cups 30 of the feed mechanism 26 release a sheet 24, if for any reason the sheet still sticks to the feed mechanism 26 with any small residual force, the angle corners 52 of the lid 18 interfere with the corners 60 of the film sheet 24 and prevent it from leaving the waste bin 22 when the feed mechanism 26 is removed.

After a used film sheet 24 has been deposited in the waste bin 22, the feed mechanism 26 moves up and forward over the lid window 20, which with the cartridge 10 inserted in the printer 16, is now open. The feed mechanism 26 now moves down through the window 20, applies suction to the cups 30, and picks up near its rear edge (not shown) a top sheet 24 of film stored in the package beneath the lid 18. The feed mechanism 26 is then rotated about its axis 33 in an angular direction as indicated by the curved arrow 34 to "peel" upward the rear portion of the top film sheet 24. In being removed from the film package through the lid window 20, the rear corners (not shown) of this sheet snap up and over a pair of angled corners 62 of the lid opening 20. If there is a second film sheet by chance sticking underneath to the top sheet being lifted by the feed mechanism 26, the corners 62 will separate the second sheet and prevent it from being removed. Thus the feeding of film sheets 24 one-by-one from the film package through the lid window 20 is positively insured. When a top sheet 24 is being removed upward from a film supply package (not shown in FIG. 1) the upward peeling and lifting action of the feed mechanism 26 draws the sheet 24 up and through the window 20. A forward edge 64 of the lid window 20 is recessed far enough back so that the center portion of a film sheet 24 in being lifted through the lid window 20 cannot scrape against this edge 64. Thus the center or "image printing" area of each film sheet 24 is positively protected against mechanical damage during the film feeding operation of the feed mechanism 26. It is noted that the rear of the cartridge 10 has a recessed edge 66 which is provided to prevent scraping of the image-area of a film sheet 24 (which dangles slightly) as it is being carried by the feed mechanism 26.

Figure 2:
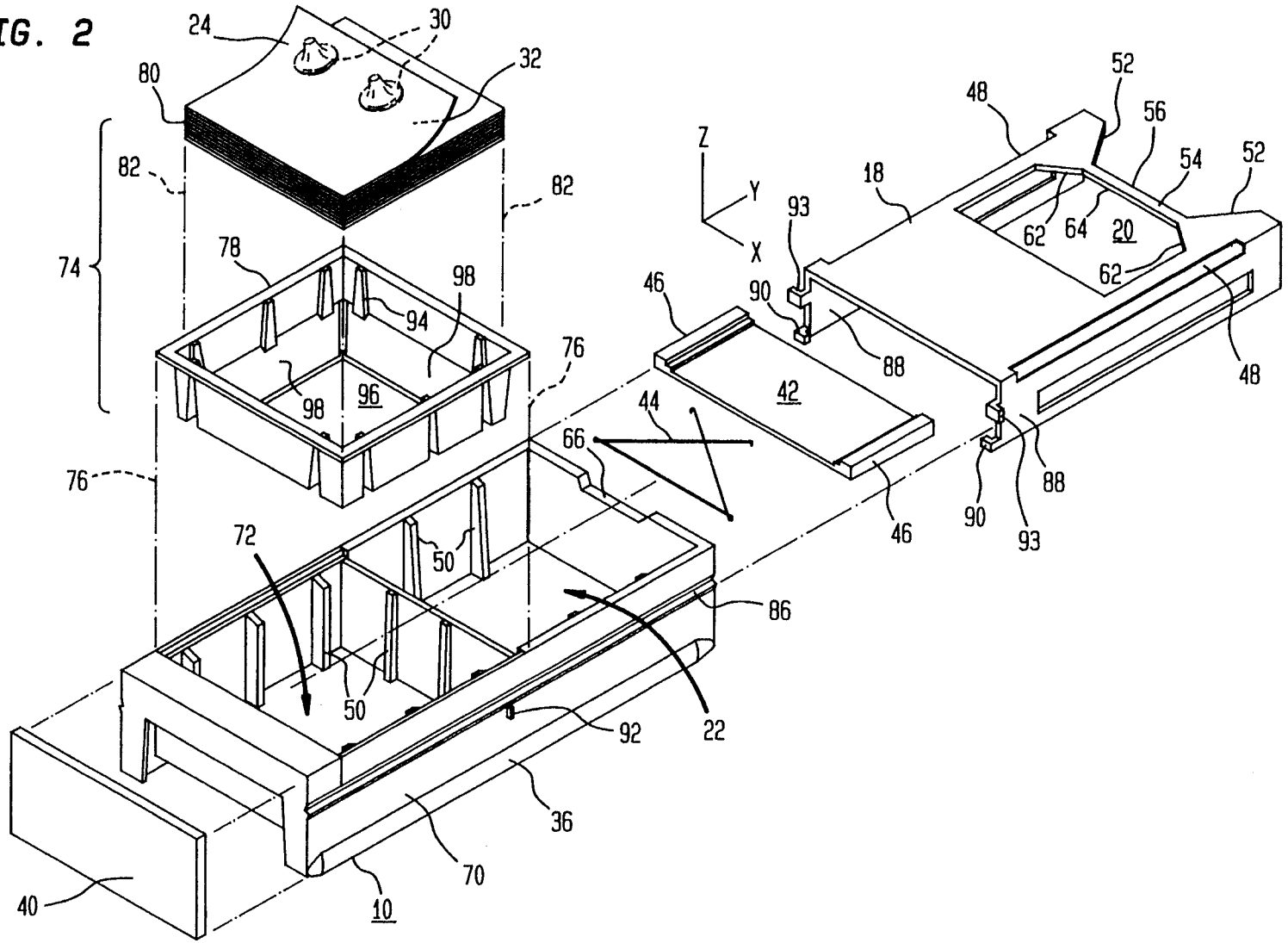
FIG. 2 shows in exploded relation the film cartridge of FIG. 1, a cup-like package of film, and a top cartridge lid in accordance with a preferred embodiment of the invention.

Referring now to FIG. 2, there are shown in exploded relation various elements associated with the cartridge 10. The top lid 18 (previously described) is advantageously of thin sheet metal shaped and formed as shown. The slat-like member 42 and the hairpin spring 44 are permanently assembled in the lid 18 (see FIG. 1) with the spring 44 normally urging the member 42 into a position closing the window 20. The cartridge 10 has a tray-like body 70 which is advantageously a one-piece plastic molding. As mentioned previously, a rear portion of the cartridge 10 defines a waste bin 22 for used sheets of film (not shown here). A front portion of the cartridge 10 defines a cavity 72 into which a package of film 74 can be placed. This is indicated by the vertical dashed lines 76. The package of film 74 comprises a cup-like container 78 and a stack 80 of sheets of film 24 which are placed within the container 78 as indicated by the vertical dashed lines 82. By way of illustration, a top-most sheet 24 of film is schematically shown here as being peeled up and off of the film stack 80 by the suction cups 30 (shown here in dashed outline). This illustrates the sheet-by-sheet film-feeding operation of the feed mechanism 26 (see FIG. 1) previously described. A factory-sealed top cover which seals the film stack 80 within the container 78 has already been removed and is not shown.

It is understood that the lid 18 (with its assembled slat-like member 42 and the spring 44) can slide forward and backward along the cartridge body 70, but normally cannot be removed from the cartridge 10. The sides of the body 70 have molded-in guides 86 (only the front one shown) which cooperate with turned-down sides 88 of the lid 18. A pair of detents 90 (which are subsequently bent as shown) on the lid sides 88 cooperate with a pair of shoulders 92 (only the front one shown) on the cartridge body 70 to prevent the lid 18 from being slipped off of the rear end of the cartridge 10 once these members are assembled (see FIG. 1). After a fresh package of film 74 has been placed in the cavity 72, the lid 18 is slid forward over the cavity 72 to cover the package of film 74 (see FIG. 1). So long as the cartridge 10 is outside of the printer 16, the lid 18 (with its window 20 closed) prevents contamination and provides mechanical protection for the film 24. When the cartridge 10 is inserted in the printer 16, a pair of bent tabs 93 at the front of the lid 18 are engaged by shoulders (not shown) in the printer to insure that the lid 18 is all the way forward. These tabs 93 also insure that the cartridge 10 is properly indexed within the printer 16.

The interior dimensions of the film container 78 are such that the individual sheets 24 of film in the stack 80 lie flat within the container. The inner walls of the container 78 have a plurality of hollow vertical ribs 94 which serve to center the stack 80 while touching the edges of the sheets of film only at discrete locations. These ribs 94, protruding within the container 78, further facilitate the removal of the sheets of film from the container 78 and also help strengthen it. The hollow ribs 94 (which are asymmetrically located as shown) mate with and slide down over the protruding ribs 50 in the cavity 72. The mating ribs thus serve to orient the film package 74 in the cavity 72. The bottom of the container 78 has a recessed central area 96 slightly below side areas 98. Being recessed, the central area 96 does not come in contact with the bottom sheet of film 24 in the stack 80. This protects the image area of the coated surface 32 (see FIG. 1) of the bottom sheet. In addition, if there is no remaining sheet of film 24 in the container 78 and the feed mechanism 26 by error tries to pick up a sheet of film 24, portions of the suction cups 30 will lie over two side areas 98 and over the recessed bottom area 96. When suction is then applied to the cups 30, there is sufficient air leakage from the recessed area 96 so that a "feed-failure" signal is generated in the printer 16. The container 78 is easily and inexpensively molded of thin-wall plastic to the configuration shown. A stack 80 of sheets 24 of film may, for example, comprise 40 sets of 5 sheets per set, with each set having a predetermined sequence of colors. Film sheets of a particular color can be repeated to achieve greater dye transfer density as desired for that color. Thermally printed images made in the printer 16 are of such detail and color balance that color transparencies are produced which rival and in some cases exceed in quality 35 mm transparencies made by photographic processes.

It is to be understood that the embodiment described herein is illustrative of the general principles of the invention. Modifications may readily be devised by those skilled in the art without departing from the spirit and scope of the invention. For example, the cartridge 10 may be made with different materials and its dimensions may be varied. The invention is not restricted to use with a particular laser printer.

We claim:

1. A film cartridge for use with a laser printer, the film cartridge comprising:

a tray-like body defining a first cavity, the first cavity being adapted to receive a package of sheets of film to be used one-by-one in the printer; and a lid slidably mounted on the tray-like body for normally covering the first cavity when a package of sheets of film is present in the first cavity, the lid having a window, and a closure for said window which is movable between an open and a closed position, said closure being arranged to close said window when the cartridge is removed from the printer and to open said window when the cartridge is inserted in the printer whereby individual sheets of film may be extracted one-by-one from the package through the open lid window for use within the printer and the film is protected from contamination and damage by the closed window when the cartridge is not in the printer.

2. The cartridge of claim 1 wherein the lid window comprises a first pair of angled corners along an edge, the angled corners interfering with adjacent corners of a sheet of film as a sheet is being drawn through the window such that mis-feeding of more than one sheet at a time is precluded.

3. The cartridge of claim 2 wherein the tray-like body has a second cavity for receiving waste sheets of film, the lid comprising a thin sheet metal cover with a second pair of angled corners at an edge of the lid over the second cavity such that sheets of film being deposited in the second cavity after use remain therein and are prevented from easily coming out of the second cavity by the second pair of angled corners.

4. A thermal printer comprising:

a film feed mechanism having a movable head for picking up and holding a thin sheet of film while carrying the sheet to or from a printing location in the printer; and a removable film supply cartridge for insertion into the printer in indexed relation to the film feed mechanism, the cartridge having a top lid and defining a first cavity normally covered for holding a supply of unused sheet film and a second cavity normally open for receiving used sheets of film, the lid having a window and a closure for the window which is movable between an open and a closed position, the closure being arranged to be opened when the cartridge is inserted into the printer whereby the sheets of film one-by-one can be drawn through the open window by the feed mechanism, and the closure being arranged to be closed when the cartridge is not in the printer such that the unused film is protected from contamination and damage by the closed window.

5. The thermal printer of claim 4 wherein the supply of unused sheet film is provided in a cup-like container which fits within the first cavity such that the film is supplied in a container in sealed condition with the sheets of film in sets in a given sequence of colors, and different cartridges with different packages of film may readily be interchanged in the printer.

6. The thermal printer of claim 5 wherein the cup-like container has a bottom having a center portion recessed below the perimeter of the bottom of the container.

7. A thermal printer comprising:

a film feed mechanism having a laterally movable and angularly rotatable head for picking up and holding a sheet of film while carrying the sheet to or from a printing location in the printer; and a removable film supply cartridge for insertion into the printer in indexed relation to the film feed mechanism, the cartridge having a top lid and defining a first cavity normally covered for holding a supply of unused sheet film and a second cavity normally open for receiving used sheets of film, the lid having a rear edge, a window and a closure for the window which is movable between an open and a closed position, the closure being arranged to be opened when the cartridge is inserted into the printer, said window having angled corners along one edge which slightly interfere with the sheet of film being picked out of the cartridge through the window by the feed mechanism such that sheets of film are drawn one-by-one through the open window by the feed mechanism, the closure being arranged to be closed when the cartridge is not in the printer such that the unused film is protected from contamination and damage.

8. The thermal printer of claim 7 wherein the supply of unused sheet film is provided in a cup-like container which fits within the first cavity, the sheets of film being supplied in a container in sealed condition with the sheets of film in sets in a given sequence of colors, the container of film being held in the cartridge by the normally closed lid.

9. The thermal printer of claim 8 wherein the cup-like container comprises internal ribs which help to strengthen the container and to center the sheets of film within the container.

10. The thermal printer of claim 8 wherein the film cartridge has a tray-like body with the first cavity in front, and the second cavity is behind the first cavity, the top lid being slidable on the tray-like body to the rear for placing the container of film in the first cavity, the lid also being slidable over the first cavity and with the window closure closed when the cartridge is not in the printer.

11. The thermal printer of claim 10 wherein the rear edge of the top lid has angled corners which slightly interfere with the used sheet of film being deposited in the second cavity by the feed mechanism such that each used sheet of film remains in the second cavity as the feed mechanism is withdrawn.

12. The thermal printer of claim 10 wherein the top lid comprises an assembly of a thin metal body, and a slat-like cover member slidably mounted in the metal body to open and close the lid window.

13. The thermal printer of claim 10 wherein the cartridge has at least one top edge which is recessed slightly to prevent it from scraping against an imaging area of a sheet of film as it is being handled by the feed mechanism.

14. The thermal printer of claim 10 wherein the tray-like body comprises molded-in guide tracks for indexing the cartridge within the printer, and the tray-like body comprises internal ribs which help to strengthen the body and to center the sheets of film within one of said cavities.

* * * * *